US008215389B2

(12) United States Patent
Nold, III et al.

(10) Patent No.: US 8,215,389 B2
(45) Date of Patent: Jul. 10, 2012

(54) APPARATUS AND METHOD FOR FORMATION EVALUATION

(75) Inventors: Raymond V. Nold, III, Beasley, TX (US); Alexander F. Zazovsky, Houston, TX (US); Steve Ervin, Brookshire, TX (US); Christopher S. Del Campo, Houston, TX (US); Stephane Briquet, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 26 days.

(21) Appl. No.: 12/779,730

(22) Filed: May 13, 2010

(65) Prior Publication Data

US 2010/0218943 A1 Sep. 2, 2010

Related U.S. Application Data

(63) Continuation of application No. 12/512,777, filed on Jul. 30, 2009, now Pat. No. 7,793,713, which is a continuation of application No. 11/739,536, filed on Apr. 24, 2007, now Pat. No. 7,584,786, which is a continuation of application No. 10/960,403, filed on Oct. 7, 2004, now Pat. No. 7,458,419.

(51) Int. Cl.
*E21B 49/10* (2006.01)

(52) U.S. Cl. ..... 166/264; 166/100; 73/152.26

(58) Field of Classification Search ..... 166/264, 166/100, 250.17, 185; 73/152.26, 152.24
See application file for complete search history.

(56) References Cited

U.S. PATENT DOCUMENTS

| | | | |
|---|---|---|---|
| 3,352,361 | A | 11/1967 | Urbanosky |
| 3,577,782 | A | 5/1971 | Aitken |
| 3,782,191 | A | 1/1974 | Whitten |
| 3,813,936 | A | 6/1974 | Urbanosky et al. |
| 3,859,851 | A | 1/1975 | Urbanosky |
| 3,864,970 | A | 2/1975 | Bell |
| 3,924,463 | A | 12/1975 | Urbanosky |
| 3,934,468 | A | 1/1976 | Brieger |
| 3,952,588 | A | 4/1976 | Whitten |
| 4,287,946 | A | 9/1981 | Brieger |
| 4,416,152 | A | 11/1983 | Wilson |

(Continued)

FOREIGN PATENT DOCUMENTS

EP 0791723 7/2003

(Continued)

OTHER PUBLICATIONS

Office Action dated Aug. 24, 2011 in the corresponding Chinese patent application.

*Primary Examiner* — David Andrews
(74) *Attorney, Agent, or Firm* — David J. Smith

(57) ABSTRACT

A method for acquiring a sample of a virgin fluid from a subsurface formation penetrated by a wellbore surrounded by a layer of contaminated fluid is disclosed. The method includes abutting a first packer against a wall of the wellbore, and extending at least a portion of a second packer beyond the first packer, wherein the second packer is at least partially disposed in the first packer. An inlet to a first flowline is at least partially defined by the first packer, and an inlet to a second flowline is defined by the second packer. The method further includes drawing one of virgin fluid, contaminated fluid and combinations thereof into the first flowline; and drawing virgin fluid into the second flowline.

8 Claims, 16 Drawing Sheets

U.S. PATENT DOCUMENTS

| | | | |
|---|---|---|---|
| 4,860,581 | A | 8/1989 | Zimmerman et al. |
| 4,936,139 | A | 6/1990 | Zimmerman et al. |
| 4,951,749 | A | 8/1990 | Carroll |
| 4,994,671 | A | 2/1991 | Safinya et al. |
| 5,056,595 | A | 10/1991 | Desbrandes |
| 5,279,153 | A | 1/1994 | Dussan et al. |
| 5,303,775 | A | 4/1994 | Michaels et al. |
| 5,377,755 | A | 1/1995 | Michaels et al. |
| 5,803,186 | A | 9/1998 | Berger et al. |
| 6,178,815 | B1 | 1/2001 | Felling et al. |
| 6,230,557 | B1 | 5/2001 | Ciglenec et al. |
| 6,301,959 | B1 | 10/2001 | Hrametz et al. |
| 6,388,251 | B1 | 5/2002 | Papanyan |
| 6,427,530 | B1 | 8/2002 | Krueger et al. |
| 6,435,279 | B1 | 8/2002 | Howe et al. |
| 6,467,544 | B1 | 10/2002 | Brown et al. |
| 6,568,487 | B2 | 5/2003 | Meister et al. |
| 6,585,045 | B2 | 7/2003 | Lee et al. |
| 6,609,568 | B2 | 8/2003 | Krueger et al. |
| 6,658,930 | B2 | 12/2003 | Abbas |
| 6,659,177 | B2 | 12/2003 | Bolze et al. |
| 6,668,924 | B2 | 12/2003 | Bolze et al. |
| 6,719,049 | B2 | 4/2004 | Sherwood et al. |
| 6,729,399 | B2 | 5/2004 | Follini et al. |
| 6,745,835 | B2 | 6/2004 | Fields |
| 6,763,884 | B2 | 7/2004 | Meister et al. |
| 6,769,296 | B2 | 8/2004 | Montalvo et al. |
| 6,871,713 | B2 | 3/2005 | Meister et al. |
| 6,964,301 | B2 | 11/2005 | Hill et al. |
| 7,080,552 | B2 | 7/2006 | Jones et al. |
| 7,128,144 | B2 | 10/2006 | Fox et al. |
| 2004/0000433 | A1* | 1/2004 | Hill et al. ..... 175/59 |
| 2004/0079527 | A1 | 4/2004 | Meister et al. |
| 2004/0144533 | A1 | 7/2004 | Zazovsky |
| 2004/0173351 | A1 | 9/2004 | Fox et al. |
| 2005/0161218 | A1 | 7/2005 | van Zuilekom et al. |

FOREIGN PATENT DOCUMENTS

| | | |
|---|---|---|
| GB | 2390105 | 12/2003 |
| SU | 968365 | 10/1982 |
| SU | 1452965 | 1/1989 |
| WO | WO03/097999 | 11/2003 |
| WO | WO03/098639 | 11/2003 |
| WO | WO2004/020982 | 3/2004 |
| WO | WO2004/081334 | 9/2004 |

* cited by examiner

FIG. 15
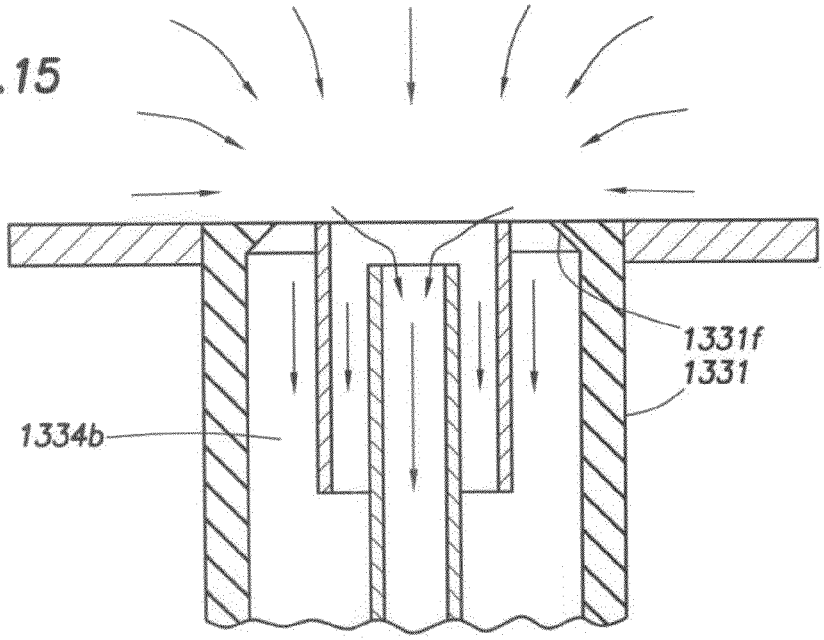
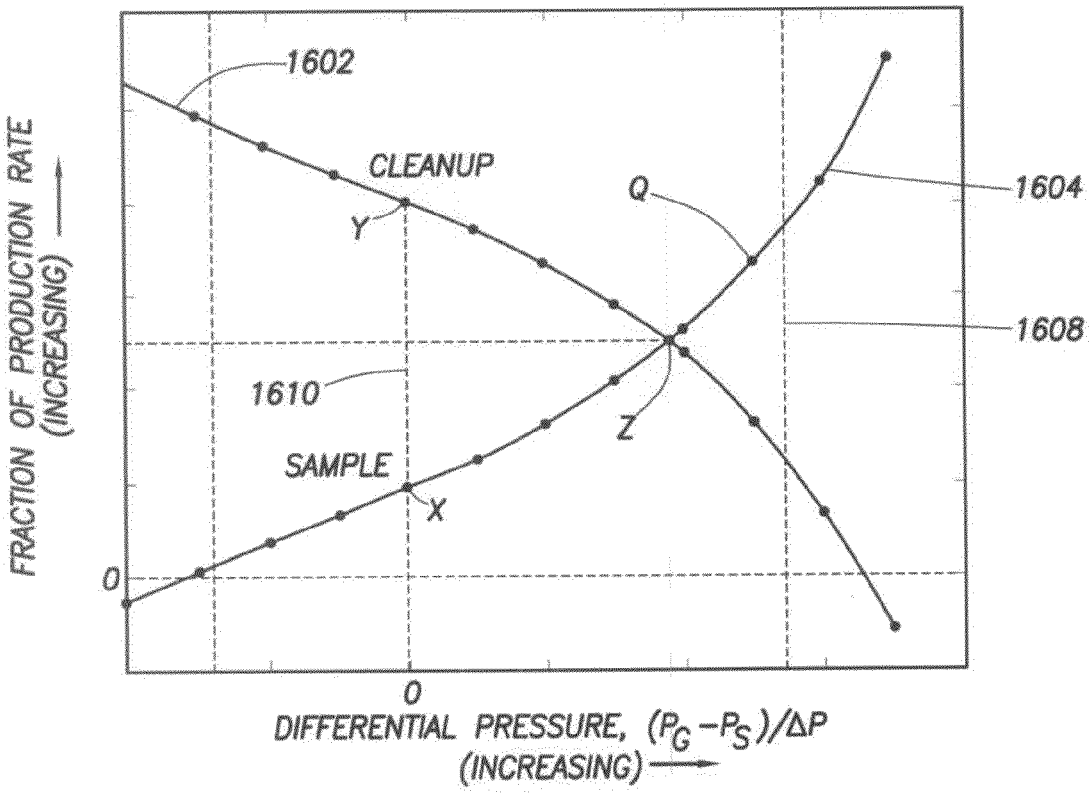
FIG. 16

APPARATUS AND METHOD FOR FORMATION EVALUATION

CROSS REFERENCE TO RELATED APPLICATIONS

This application is a continuation application of U.S. patent application Ser. No. 12/512,777, filed Jul. 30, 2009, now U.S. Pat. No. 7,793,713, which is a continuation application of U.S. patent application Ser. No. 11/739,536, filed Apr. 24, 2007, now U.S. Pat. No. 7,584,786, which is a continuation application of U.S. patent application Ser. No. 10/960,403, filed Oct. 7, 2004, now U.S. Pat. No. 7,458,419, the entire contents of each being hereby incorporated herein by reference.

BACKGROUND OF THE INVENTION

1. Field of the Invention

The present invention relates to techniques for evaluating a subsurface formation using a probe assembly conveyed on a downhole tool positioned in a wellbore penetrating the subsurface formation. More particularly, the present invention relates to techniques for reducing the contamination of formation fluids drawn into and/or evaluated by the downhole tool via the probe assembly.

2. Background of the Related Art

Wellbores are drilled to locate and produce hydrocarbons. A string of downhole pipes and tools with a drill bit at an end thereof, commonly known in the art as a drill string, is advanced into the ground to form a wellbore penetrating (or targeted to penetrate) a subsurface formation of interest. As the drill string is advanced, a drilling mud is pumped down through the drill string and out the drill bit to cool the drill bit and carry away cuttings and to control downhole pressure. The drilling mud exiting the drill bit flows back up to the surface via the annulus formed between the drill string and the wellbore wall, and is filtered in a surface pit for recirculation through the drill string. The drilling mud is also used to form a mudcake to line the wellbore.

It is often desirable to perform various evaluations of the formations penetrated by the wellbore during drilling operations, such as during periods when actual drilling has temporarily stopped. In some cases, the drill string may be provided with one or more drilling tools to test and/or sample the surrounding formation. In other cases, the drill string may be removed from the wellbore (called a "trip") and a wireline tool may be deployed into the wellbore to test and/or sample the formation. Such drilling tools and wireline tools, as well as other wellbore tools conveyed on coiled tubing, are also referred to herein simply as "downhole tools." The samples or tests performed by such downhole tools may be used, for example, to locate valuable hydrocarbons and manage the production thereof.

Formation evaluation often requires that fluid from the formation be drawn into a downhole tool for testing and/or sampling. Various devices, such as probes and/or packers, are extended from the downhole tool to isolate a region of the wellbore wall, and thereby establish fluid communication with the formation surrounding the wellbore. Fluid may then be drawn into the downhole tool using the probe and/or packer.

A typical probe employs a body that is extendable from the downhole tool and carries a packer at an outer end thereof for positioning against a sidewall of the wellbore. Such packers are typically configured with one relatively large element that can be deformed easily to contact the uneven wellbore wall (in the case of open hole evaluation), yet retain strength and sufficient integrity to withstand the anticipated differential pressures. These packers may be set in open holes or cased holes. They may be run into the wellbore on various downhole tools.

Another device used to form a seal with the wellbore sidewall is referred to as a dual packer. With a dual packer, two elastomeric rings are radially expanded about a downhole tool to isolate a portion of the wellbore wall therebetween. The rings form a seal with the wellbore wall and permit fluid to be drawn into the downhole tool via the isolated portion of the wellbore.

The mudcake lining the wellbore is often useful in assisting the probe and/or dual packers in making the appropriate seal with the wellbore wall. Once the seal is made, fluid from the formation is drawn into the downhole tool through an inlet therein by lowering the pressure in the downhole tool. Examples of probes and/or packers used in downhole tools are described in U.S. Pat. Nos. 6,301,959; 4,860,581; 4,936,139; 6,585,045; 6,609,568 and 6,719,049 and U.S. Patent Application No. 2004/0000433.

Techniques currently exist for performing various measurements, pretests and/or sample collection of fluids that enter the downhole tool. However, it has been discovered that when the formation fluid passes into the downhole tool, various contaminants, such as wellbore fluids and/or drilling mud may, and often do, enter the tool with the formation fluids. The problem is illustrated in FIG. 1, which depicts a subsurface formation 16 penetrated by a wellbore 14 and containing a virgin fluid 22. A layer of mud cake 15 lines a sidewall 17 of the wellbore 14. Due to invasion of mud filtrate into the formation during drilling, the wellbore is surrounded by a cylindrical layer known as the invaded zone 19 containing contaminated fluid 20 that may or may not be mixed with the desirable virgin fluid 22 that lies in the formation beyond the sidewall of the wellbore and surrounds the contaminated fluid 20. Since the contaminates 20 tend to be located near the wellbore wall 17 in the invaded zone 19, they may affect the quality of measurements and/or samples of the formation fluids. Moreover, contamination may cause costly delays in the wellbore operations by requiring additional time for more testing and/or sampling. Additionally, such problems may yield false results that are erroneous and/or unusable.

FIG. 2A shows the typical flow patterns of formation fluids as they pass from a subsurface formation 16 into a wireline-conveyed downhole tool 1*a*. The downhole tool 1*a* is positioned adjacent the formation 16 and a probe 2*a* is extended from the downhole tool through the mudcake 15 to sealingly engage the sidewall 17 of the wellbore 14. The probe 2*a* is thereby placed in fluid communication with the formation 16 so that formation fluid may be passed into the downhole tool 1*a*. Initially, as shown in FIG. 1, the invaded zone 19 surrounds the sidewall 17 and contains contaminates 20. As a pressure differential is created by the downhole tool 1*a* to draw fluid from the formation 16, the contaminated fluid 20 from the invaded zone 19 is first drawn (not particularly shown in FIG. 1 or 2A) into the probe thereby producing fluid unsuitable for sampling. However, after a certain amount of contaminated fluid 20 passes through the probe 2*a*, the virgin fluid 22 breaks through the invaded zone 19 and begins entering the downhole tool 1*a* via the probe 2*a*. More particularly, as shown in FIG. 2A, a central portion of the contaminated fluid 20 flowing from the invasion zone 19 into the probe gives way to the virgin fluid 22, while the remaining portion of the produced fluid is contaminated fluid 20. The challenge remains in adapting to the flow of the formation fluids so that the virgin fluid is reliably collected in the downhole tool 1*a* during sampling.

FIG. 2 B shows the typical flow patterns of formation fluids as they pass from a subsurface formation 16 into a drill string-conveyed downhole tool 1*b*. The downhole tool 1*b* is conveyed among one or more (or itself may be) measurement-while-drilling (MWD), logging-while-drilling (LWD), or other drilling tools that are know to those skilled in the art. The downhole tool 1*b* may be disposed between a tool or work string 28 and a drill bit 30, but may also be disposed in other manners know to those or ordinary skill in the art. The downhole tool 1*b* employs a probe 2*b* to sealingly engage and draw fluid from the formation 16, in similar fashion to the downhole tool 1*a* and probe 2*a* described above.

It is therefore desirable that sufficiently "clean" or "virgin" fluid be extracted or separated from the contaminated fluid for valid testing. In other words, the sampled formation fluid should have little or no contamination. Attempts have been made to eliminate contaminates from entering the downhole tool with the formation fluid. For example, as depicted in U.S. Pat. No. 4,951,749, filters have been positioned in probes to block contaminates from entering the downhole tool with the formation fluid.

Other techniques directed towards eliminating contaminates during sampling are provided by published U.S. Patent Application No. 2004/0000433 to Hill et al. and U.S. Pat. No. 6,301,959 to Hrametz et al., the entire contents of both being hereby incorporated by reference. FIGS. 3 and 4 are schematic illustrations of the probe solution disclosed by the Hrametz patent. Hrametz describes a fluid sampling pad 13 mechanically pressed against the borehole wall. A probe tube 18 extends from the center of the pad and is connected by a flowline 23*a* to a sample chamber 27*a*. A guard ring 12 surrounds the probe and has openings connected to its own flowline 23*b* and sample chamber 27*b*. This configuration is intended to create zones so that fluid flowing into the probe is substantially free of contaminating borehole fluid.

Despite such advances in fluid sampling, there remains a need to reduce contamination during formation evaluation. In some cases, cross-flow between adjacent flowlines may cause contamination therebetween. It is desirable that techniques be provided to assist in reducing the flow of contamination of formation fluid entering the downhole tool and/or isolate clean formation fluid from contaminates as the clean fluid enters the downhole tool. It is further desirable that such a system be capable of one of more of the following, among others: providing a good seal with the formation; enhancing the flow of clean fluid into the tool; optimizing the flow of fluid into the downhole tool; avoiding contamination of clean fluid as it enters the downhole tool; separating contaminated fluid from clean fluid; optimizing the flow of fluid into the downhole tool to reduce the contamination of clean fluid flowing into the downhole tool; and/or providing flexibility in handling fluids flowing into the downhole tool.

DEFINITIONS

Certain terms are defined throughout this description as they are first used, while certain other terms used in this description are defined below:

"Annular" means of, relating to, or forming a ring, i.e., a line, band, or arrangement in the shape of a closed curve such as a circle or an ellipse.

"Contaminated fluid" means fluid that is generally unacceptable for hydrocarbon fluid sampling and/or evaluation because the fluid contains contaminates, such as filtrate from the mud utilized in drilling the borehole.

"Downhole tool" means tools deployed into the wellbore by means such as a drill string, wireline, and coiled tubing for performing downhole operations related to the evaluation, production, and/or management of one or more subsurface formations of interest.

"Operatively connected" means directly or indirectly connected for transmitting or conducting information, force, energy, or matter (including fluids).

"Virgin fluid" means subsurface fluid that is sufficiently pure, pristine, connate, uncontaminated or otherwise considered in the fluid sampling and analysis field to be acceptably representative of a given formation for valid hydrocarbon sampling and/or evaluation.

SUMMARY OF THE INVENTION

In one aspect of the disclosure a probe assembly for employment by a downhole tool is disclosed. The tool is disposed in a wellbore surrounded by a layer of contaminated fluid, wherein the wellbore penetrates a subsurface formation having a virgin fluid therein beyond the layer of contaminated fluid. The tool includes a probe body that is extendable from the downhole tool, an outer packer and an inner packer. The outer packer has a bore therethrough and is disposed in the probe body for sealingly engaging a first portion of the wellbore. The inner packer is disposed in the bore of the outer packer and forms an annulus therebetween. The inner packer is extendable beyond an outer surface of the outer packer for sealingly engaging a second portion of the wellbore within the first portion. A first inlet in the probe body fluidly communicates with the annulus for admitting one of virgin fluid, contaminated fluid and combinations thereof into the downhole tool, and a second inlet in the probe body fluidly communicates with the inner packer for admitting virgin fluid into the downhole tool.

In another aspect of the disclosure, a method for acquiring a sample of a virgin fluid from a subsurface formation penetrated by a wellbore surrounded by a layer of contaminated fluid is disclosed. The method includes abutting an outer surface of a first packer against a first portion of a wall of the wellbore, abutting an outer surface of a second packer against a second portion of a wall of the wellbore, wherein the outer surface of the second packer penetrates a plane defined by the outer surface of the first packer, drawing one of virgin fluid, contaminated fluid and combinations thereof from an annular portion of the wellbore between the first and second packers, and drawing virgin fluid from a portion of the wellbore at least partially defined by the second packer.

In yet another aspect of the disclosure, a method for acquiring a sample of a virgin fluid from a subsurface formation penetrated by a wellbore surrounded by a layer of contaminated fluid is disclosed. The method includes abutting a first packer against a wall of the wellbore, wherein an inlet to a first flowline is at least partially defined by the first packer, extending at least a portion of a second packer beyond the first packer, the second packer being at least partially disposed in the first packer, wherein an inlet to a second flowline is defined by the second packer, drawing one of virgin fluid, contaminated fluid and combinations thereof into the first flowline, and drawing virgin fluid into the second flowline.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIG. 15 is a schematic elevational view of the probe assembly of FIG. 13 with an inner flange.

FIG. 16 is a graph depicting the relationship between differential pressure versus share of sampling rate between a sampling intake and a cleanup intake.

DETAILED DESCRIPTION OF THE INVENTION

Figure 2B:
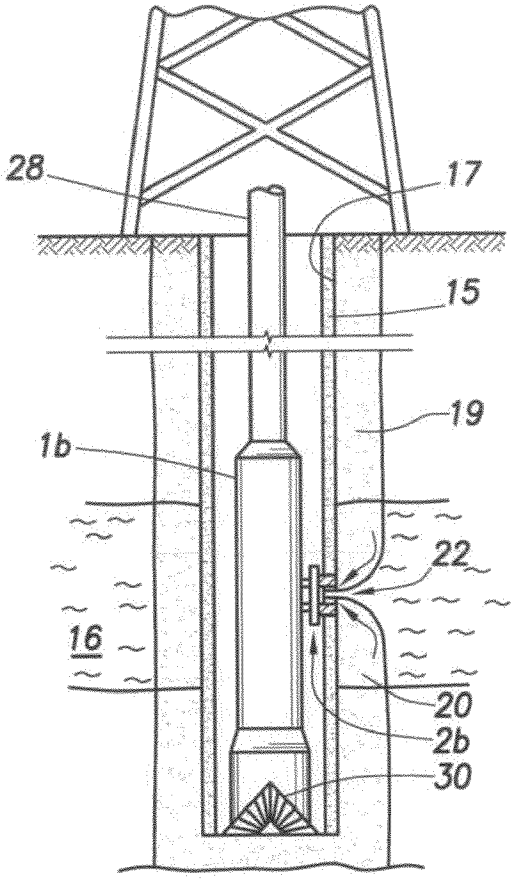
FIG.2B (PRIOR ART)
FIGS. 2A-2B are schematic elevational views of respective wireline-conveyed and drill string-conveyed downhole tools each positioned in the wellbore of FIG. 1 with a probe engaging the formation, and further depicting the flow of contaminated and virgin fluid into the downhole tool.
Figure 2A:
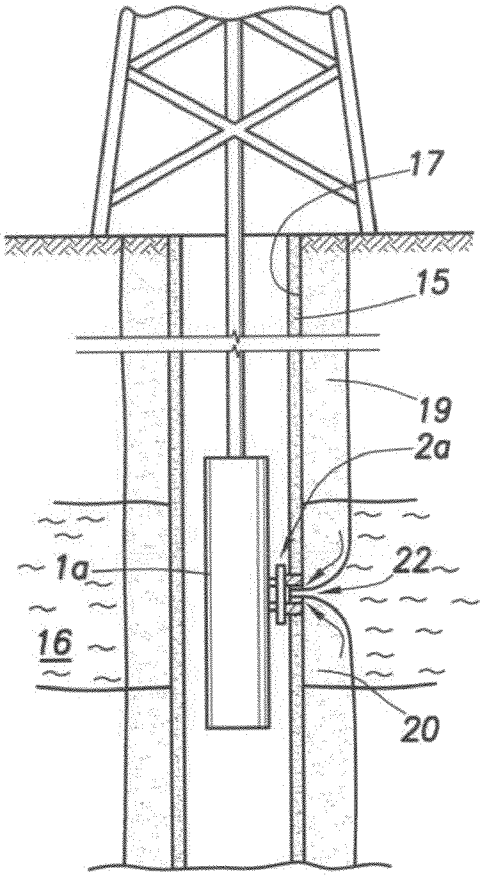
FIG.2A (PRIOR ART)

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 5:
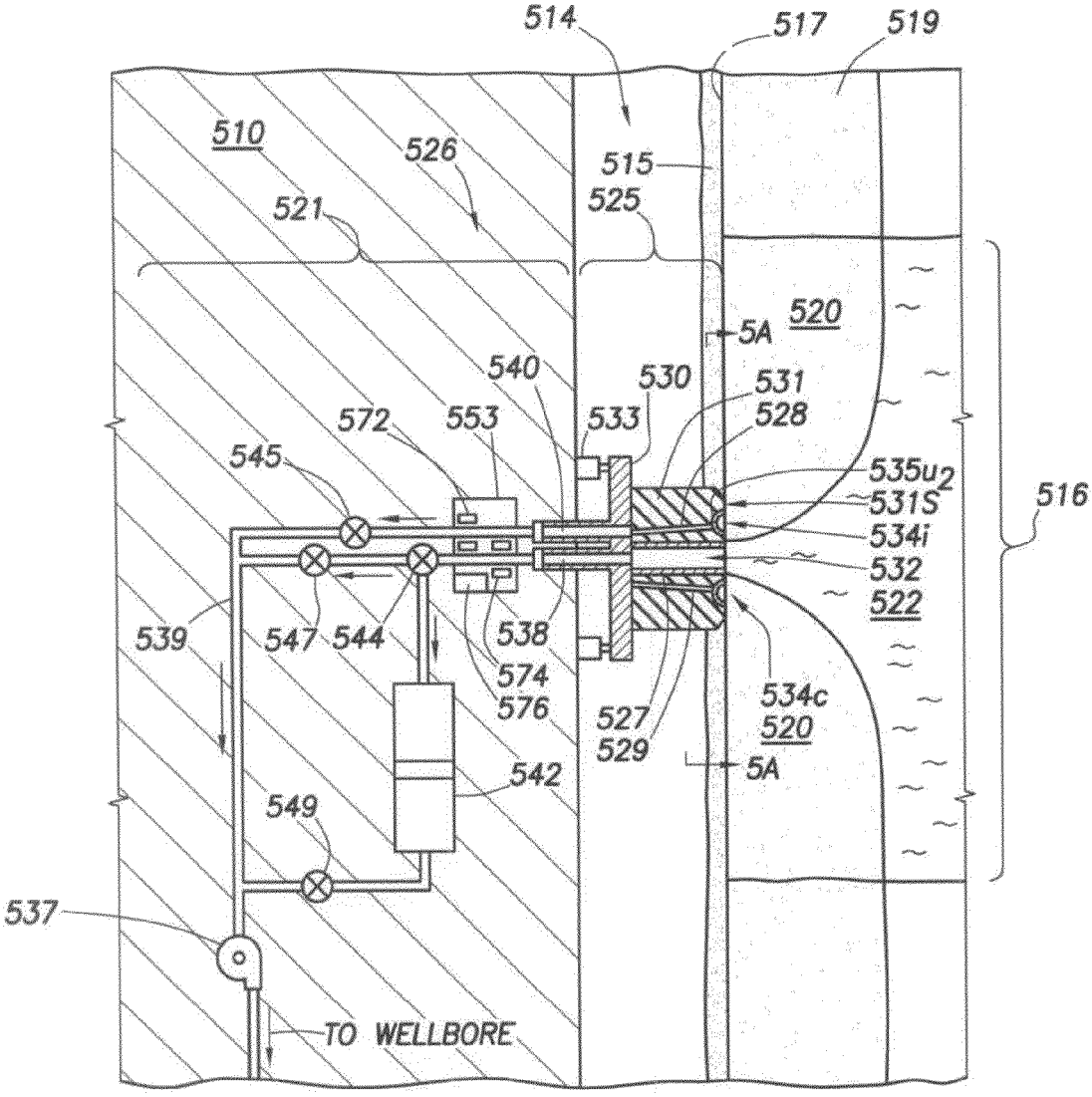
FIG. 5 is a schematic elevational view of portion of a downhole tool having a fluid sampling system and a probe assembly.

Referring now to FIG. 5, a fluid sampling system 526 of a downhole tool 510 is shown to include a probe assembly 525 and a flow section 521 for selectively drawing formation fluid into the desired portion of the downhole tool. The downhole tool 510 is conveyed in a wellbore 514 surrounded by an invaded zone 519 containing a layer of contaminated fluid 520. The wellbore 514 penetrates a subsurface formation 516 having a virgin fluid 522 therein beyond the layer of contaminated fluid 520.

The probe assembly 525 includes a probe body 530 selectively extendable from the downhole tool 510 using extension pistons 533 or another suitable actuator for moving the probe body between a retracted position for conveyance of the downhole tool and an extended position for sampling fluid (the latter position being shown in FIG. 5). A cylindrical packer 531 is carried by the probe body 530 and has a distal surface 531*s* adapted for sealingly engaging the mudcake 515 and sealingly engaging a portion of the wellbore wall 517. The distal surface may be formed with a curvature, as shown by the surface 531*s*' in the packer embodiment of FIG. 6, so as to match the anticipated curvature of the wellbore wall 517 for a more reliable seal therewith.

Figure 5A:
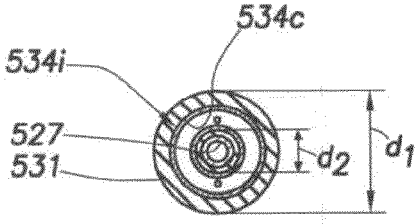
FIG. 5A is sectional view of the probe assembly of FIG. 5, taken along section line 5A-5A.

With reference now to FIG. 5A, the packer 531 is made of a suitable material (well known in the art), such as rubber, and has an outer diameter $d_1$ and an inner diameter $d_2$, with the inner diameter $d_2$ being defined by a bore (not numbered) through the packer. The packer 531 is further equipped with a channel 534*c* formed in the distal surface 531*s* thereof and arranged to define an annular cleanup intake 534*i* intermediate the inner and outer diameters $d_1$, $d_2$. The packer 531 may be made by casting the packer material around a sampling tube 527 (also described below), thereby integrally forming these components of the packer assembly 525. The intake channel (or channels, as the case may be) is then cut in the packer's distal surface 531*s* (i.e., its face) to create the annular cleanup intake area 534*i*.

Figure 7A:
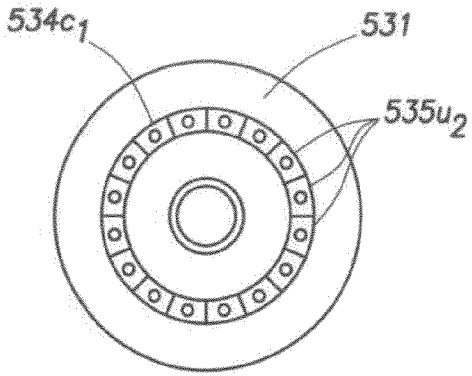
FIGS. 7A-7F illustrates various configurations for an annular cleanup intake employable by the probe assembly.
Figure 7B:
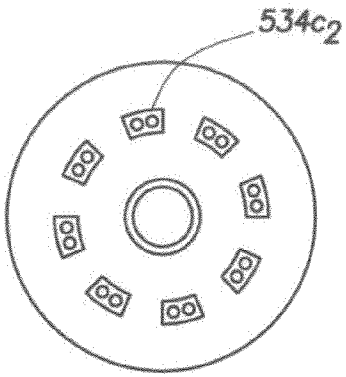
Figure 7C:
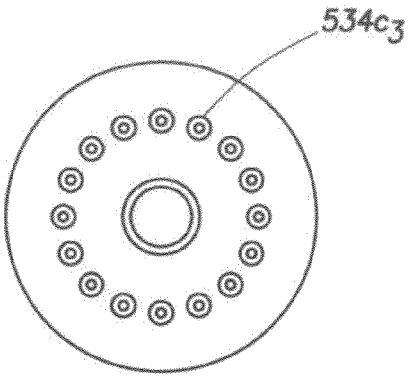
Figure 7D:
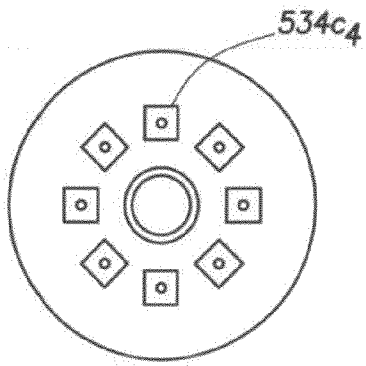
Figure 7E:
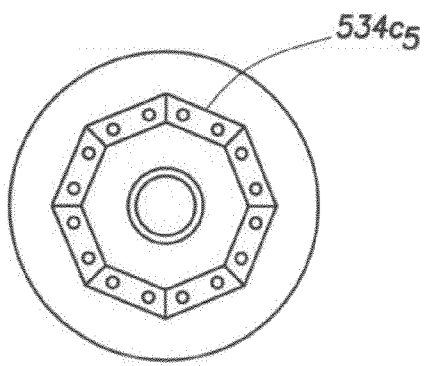
Figure 7F:
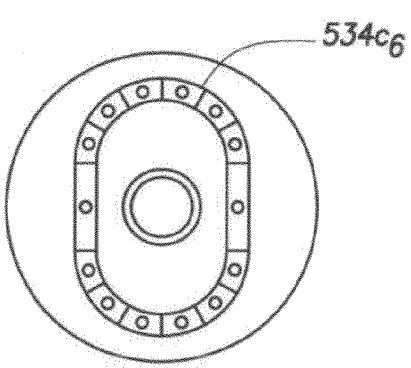
Figure 8A:
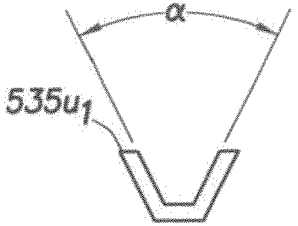
FIG. 8A-8G illustrate end views for various braces, or bracing elements, employable in the annular cleanup intake of the probe assembly.
Figure 8B:
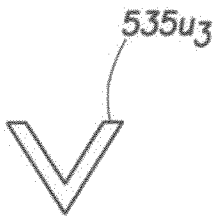
Figure 8C:
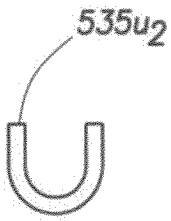
Figure 8D:
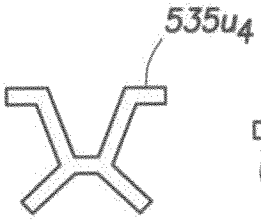
Figure 8E:
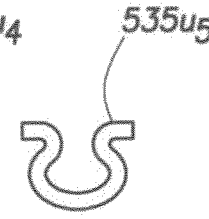
Figure 8F:
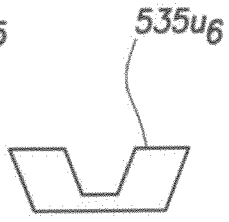
Figure 8G:
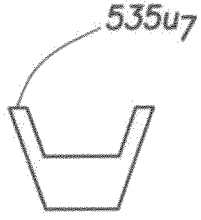
Figure 8H:
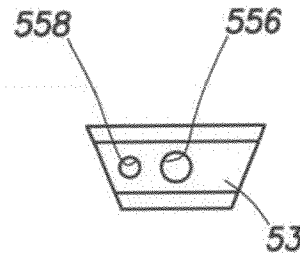
FIG. 8H-8N illustrate plan views for the various braces, or bracing elements, employable in the annular cleanup intake of the probe assembly.
Figure 8I:
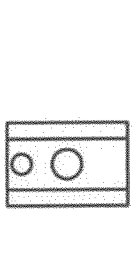
Figure 8J:
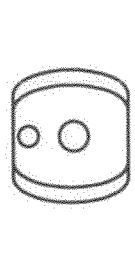
Figure 8K:
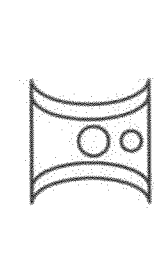
Figure 8L:
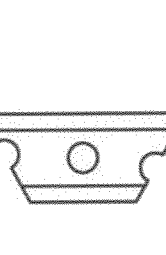
Figure 8M:
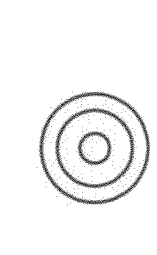
Figure 8N:
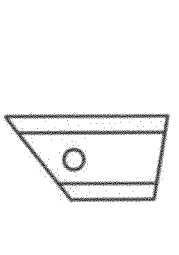

Various aspects of the probe depicting details concerning the packer braces 535$u_2$, the cleanup intake 534*i* and associated channel(s) 534*c* of FIG. 5 are shown in FIGS. 7A-9B. While the embodiment of FIGS. 5 and 5A is shown to have a single continuous channel 534*c*, the invention encompasses packer embodiments having pluralities of discrete channels that are arranged to define the annular cleanup intake 534*i*. Thus, with reference now to FIGS. 7A-F, the packer 531 may employ a variety of configurations, such as a single continuous channel 534$c_1$, a plurality of spaced trapezoidal channels 534$c_2$, spaced circular channels 534$c_3$, spaced rectangular channels 534$c_4$, contiguous trapezoidal channels 534$c_5$, and elongated channels 534$c_6$. The channel and/or cleanup intakes may be arranged to form a circle as depicted by FIG. 7A, an oval as depicted in FIG. 7F, or other geometries.

FIGS. 7A-F further illustrate a plurality of braces (also called bracing elements) 535 disposed in the one or more channels. These braces, as well as other brace configurations, are depicted in greater detail in FIGS. 8A-8N. The braces employ various shapes to complement the channel shapes, and may further employ a variety of cross-sections including the various U, V, X, and Ω-shaped cross-sections employed by the braces 535$u_1$-535$u_7$ (shown in FIGS. 8A-8G) and various symmetrical and non-symmetrical plan profiles (shown in FIG. 8H-8N).

Figure 9A:
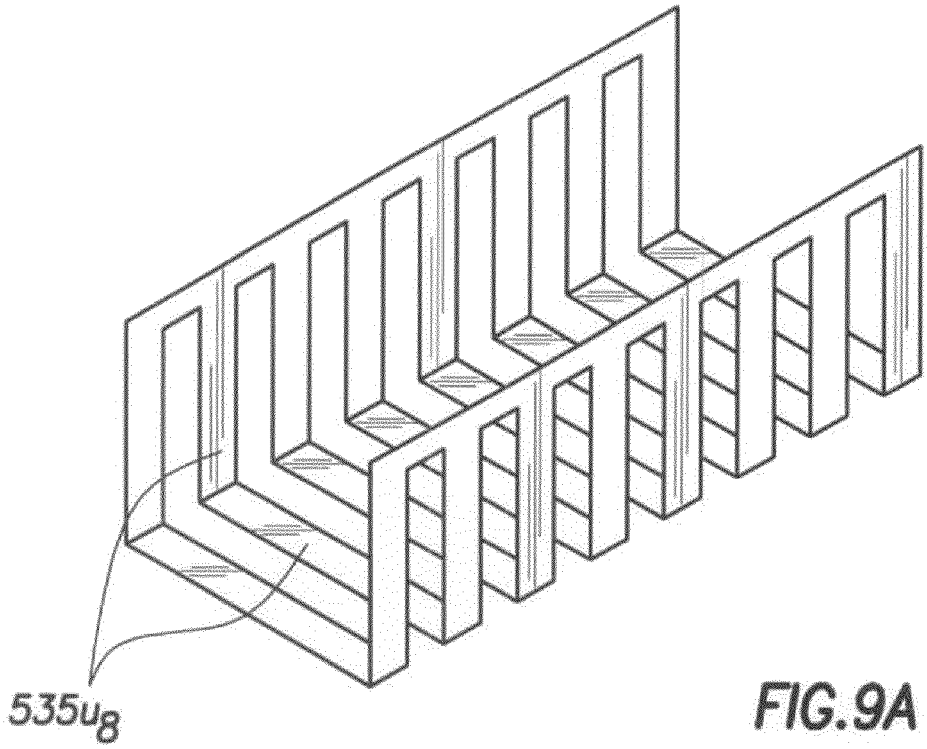
FIGS. 9A-9B illustrate further configurations for braces employable in the annular cleanup intake of the probe assembly.
Figure 9B:
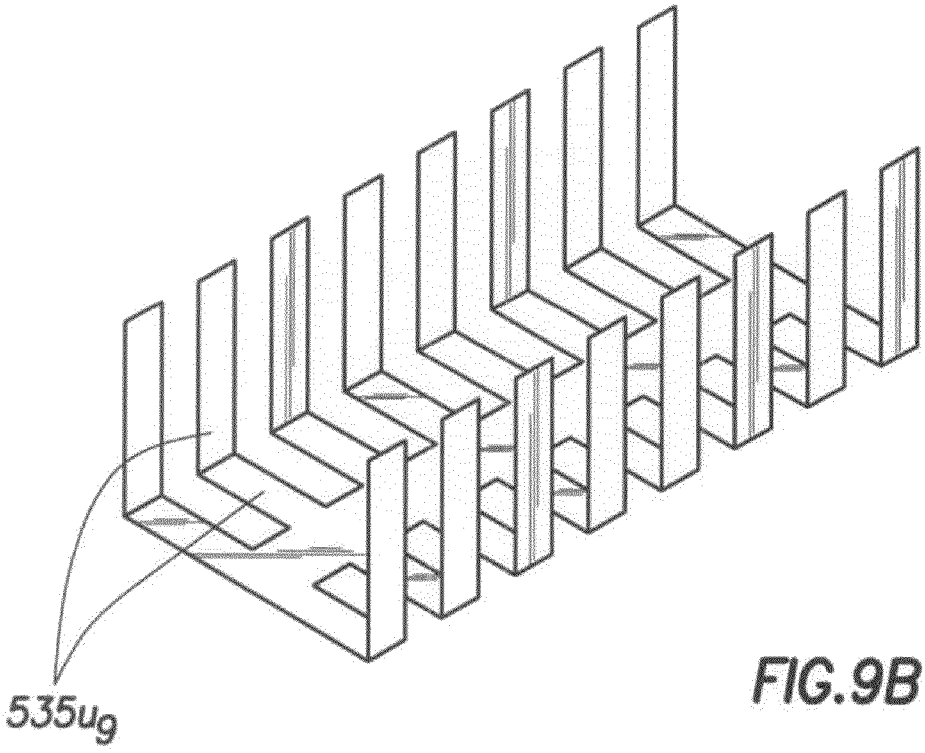

Further alternative embodiments of the braces 535$u_{8\text{-}9}$ are depicted in FIGS. 9A-9C. Thus, the braces may employ a plurality of parallel linear components 535*u* that are operatively connected (at upper sides of braces 535$u_8$ in FIG. 9A; at central base portions of braces 535$u_9$ in FIG. 9B) so as to form various grate-like or screen-like assemblies. Those having ordinary skill in the art will appreciate the various other configurations may be similarly employed to operatively connect a plurality of braces, and thereby achieve improved deformability of the packer 531. The benefits of such improved deformability which will now be described.

Referring back to FIGS. 7A-F, the braces 535*u* are preferably operatively connected to define a flexible bracing ring, e.g., in chain-link fashion, and shaped in a closed curve to fit the one or more channels 534*c*. In this regard, FIG. 8H further illustrates that the braces 535 may be equipped with a first aperture 556 therein for conducting fluid to the packer passageways 528 (described below), and a second aperture 558 therein for linking the braces together and/or for securing the braces within the packer material. These apertures may be of varying shapes, sizes, and configurations in the respective braces. Those having ordinary skill in the art will appreciate that the braces facilitate desirable movement of the probe assembly 525, particularly the packer 531, during sampling operations (see, e.g., FIG. 5). This is because the seal formed across the packer distal surface 531*s* is dependent on the deformability of the packer across its face (particularly true in open hole applications). A conventional packer tends to move all at once as a solid piece. This is also somewhat true in prior art packers that employ solid guard rings. The use of discrete, but operatively connected, braces in accordance with the present invention provides improved elastic deformability to the packer 531. Thus, e.g., portions of the packer surface 531*s* within the annular cleanup intake 534*i* are more free to deform independently of the portions of the packer surface 531*s* outside the annular cleanup intake 534*i*.

The packer braces 535 may be integrally formed with the packer 531 such as through vulcanization, or, if sufficiently flexible, the braces may be press-fitted into the one or more packer channels 534*c*. In any case, the braces must have sufficient rigidity and/or spring stiffness to resist collapsing of the packer material as the packer is compressed against the wellbore wall 517. This stiffness may be achieved by appropriate material selection and by geometry. Thus, e.g., certain of the brace embodiments 535$u_1$ shown in FIGS. 6 and 8A have U-shaped cross-sections with openings defined by an angle $\alpha$ of preferably 7° or more.

Referring again to FIG. 5, at least one passageway 528 extends through the packer 531 for conducting one of virgin fluid 522, contaminated fluid 520 and combinations thereof between the one or more channels 534*c* and a first inlet 540 in the probe body 530. The first inlet 540 in the probe body fluidly communicates with the downhole tool 510 in a manner that is described below. In embodiments having a plurality of channels forming the annular cleanup intake 534*i*, the packer 531 is equipped with a plurality of respective passageways 528 each extending therethrough for conducting one of virgin fluid 522, contaminated fluid 520 and combinations thereof between one of the channels 534*c* and the first inlet 540 in the probe body 530.

Each of the passageways 528 in the packer 531 is preferably lined with a tube 529, e.g., for bracing against the packer material collapsing upon the passageway under compressive loading. The tubes are preferably fixed at the upper end thereof to the respective channel brace 535$u_2$, and somewhat free-floating at the lower end thereof within one or more grooves 530*g* in the probe body 530 (see FIG. 6) to allow for compression of the packer material under loading. Such tubes may be integrally formed with the packer 531, e.g., by casting the packer about the tubes, which process lends itself to the use of tubes—and resulting passageways 528—having differing shapes and configurations. A spring 509 (FIG. 6), or series of rings, may be inserted into passageway 528 and/or tube 529 to assist in preventing the passageway from collapsing.

Figure 10A:
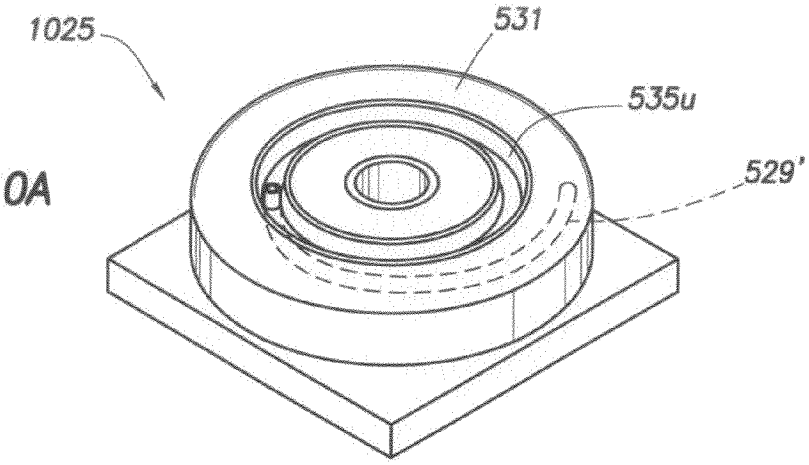
FIGS. 10A and 10B illustrate various shapes for fluid passageways employable in the probe assembly.
Figure 10B:
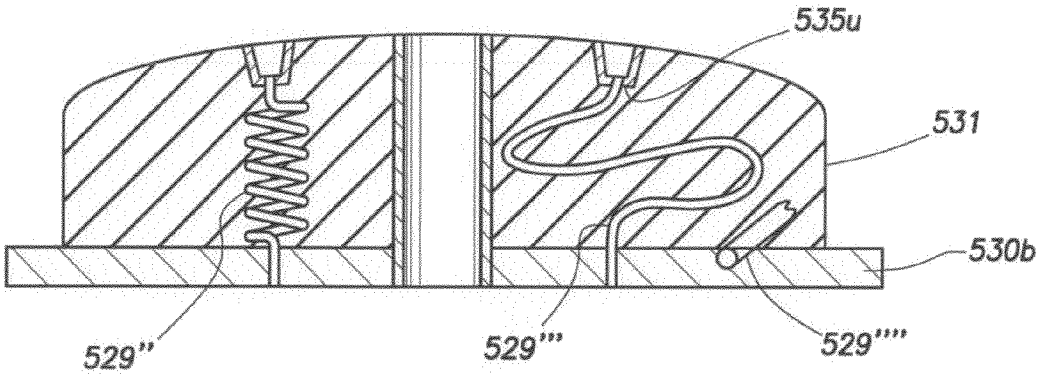

FIG. 10A illustrates another probe assembly 1025 depicting passageways 529 therethrough. The probe assembly is essentially the same as the probe assembly of FIG. 5, except that it has passageways of various configurations extending through the packer 531. The shape of the passageways is defined by a spiral-shaped tube 529'. FIG. 10B illustrates a packer 531 employing tubes of differing shapes, e.g., helically-coiled tube 529", S-shaped tube 529''', and complementing passageways therein. These various arcuate tubes need not necessarily having either end floating (as in FIG. 6) since the vertical movement the tubes will experience under compressive loading of the packer material will largely be borne by the laterally-extending portions of the tubes. FIG. 10B further illustrates that the tube ends can be terminated at the probe body (e.g., at a baseplate 530*b*) in different orientations, such as perpendicular (see 529''') or parallel (see 529'''') to the face of the baseplate.

Referring again to FIG. 5, as mentioned above, a sampling tube 527 is sealingly disposed in the bore of the packer 531 for conducting virgin fluid 522 to a second inlet 538 in the probe body 530. The second inlet 538 in the probe body also fluidly communicates with the downhole tool, and is described further below.

The sampling tube 527 defines a sampling intake 532, and cooperates with the inner portion of the packer 531 to define a barrier (not numbered) isolating the annular cleanup intake 534*i* from the sampling intake 532. While the sampling tube 527 is preferably concentric with the packer 531, other geometries and configurations of the packer/probe may be employed to advantage.

Figure 6:
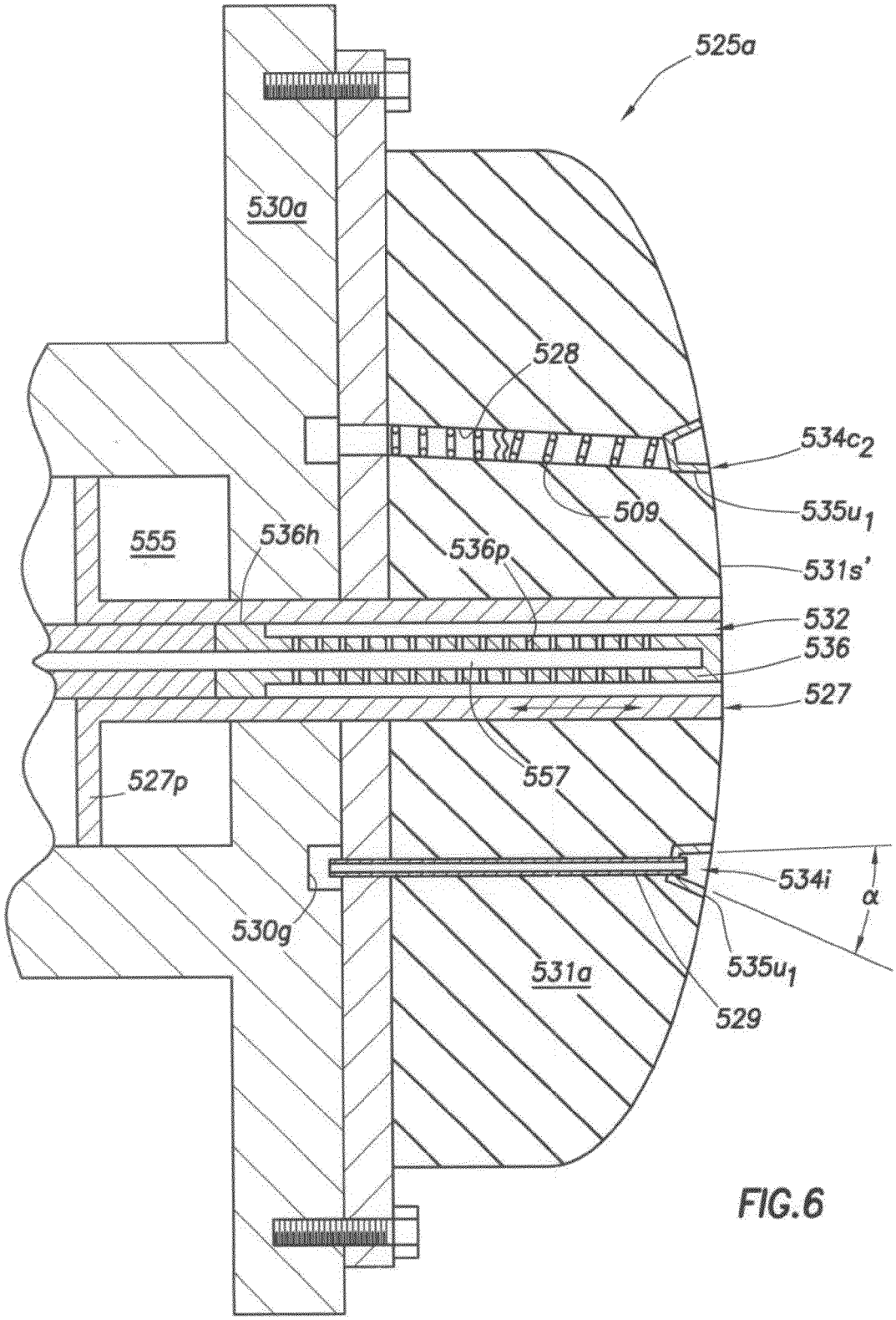
FIG. 6 is a detailed schematic view of an alternate probe assembly to that of FIG. 5.

Referring now to FIG. 6, an alternate probe assembly 525*a* is depicted. This probe assembly is similar to the probe assembly 525 of FIG. 5, with some variations. For example, packer 531*a* is positioned on probe body 530*a* and has a piston 536 extending therethrough. The passageway 528 also has an annular cleanup intake 534, with channels 534$c_2$ and channel braces 535$u_1$. The sampling tube 527 may itself be extendable from the probe body 530*a* under hydraulic pressure supplied by the downhole tool against piston legs 527*p* disposed for slidable movement within a chamber 555 to assist in isolating the sampling intake 532 from the annular cleanup intake 534*i*. This feature is particularly beneficial when encountering erosion of the wellbore wall opposite the sampling intake 532.

The sampling tube 527 is preferably equipped with a filter for filtering particles from the virgin formation fluid admitted to the sampling intake 532 of the sampling tube 527. Such filtering action may be provided by a plurality of perforations 536*p* in the sidewall of a piston 536 slidably disposed in the sampling tube 527. The piston 536 is extendable under hydraulic pressure from the probe body 530*a*, and includes a piston head 536*h* having an enlarged diameter for engaging and ejecting particles (e.g., drilling mud buildup) from the sampling intake 532 upon extension of the piston 536 relative to the sampling tube 527. The piston further includes, e.g., an axial passageway 557 therein that fluidly communicates with the perforations 536*p* in the piston sidewall for conducting virgin fluid admitted to the sampling intake 532 to the axial passageway. The axial passageway fluidly communicates with the second inlet 538 (FIG. 5) in the probe body.

Figure 11:
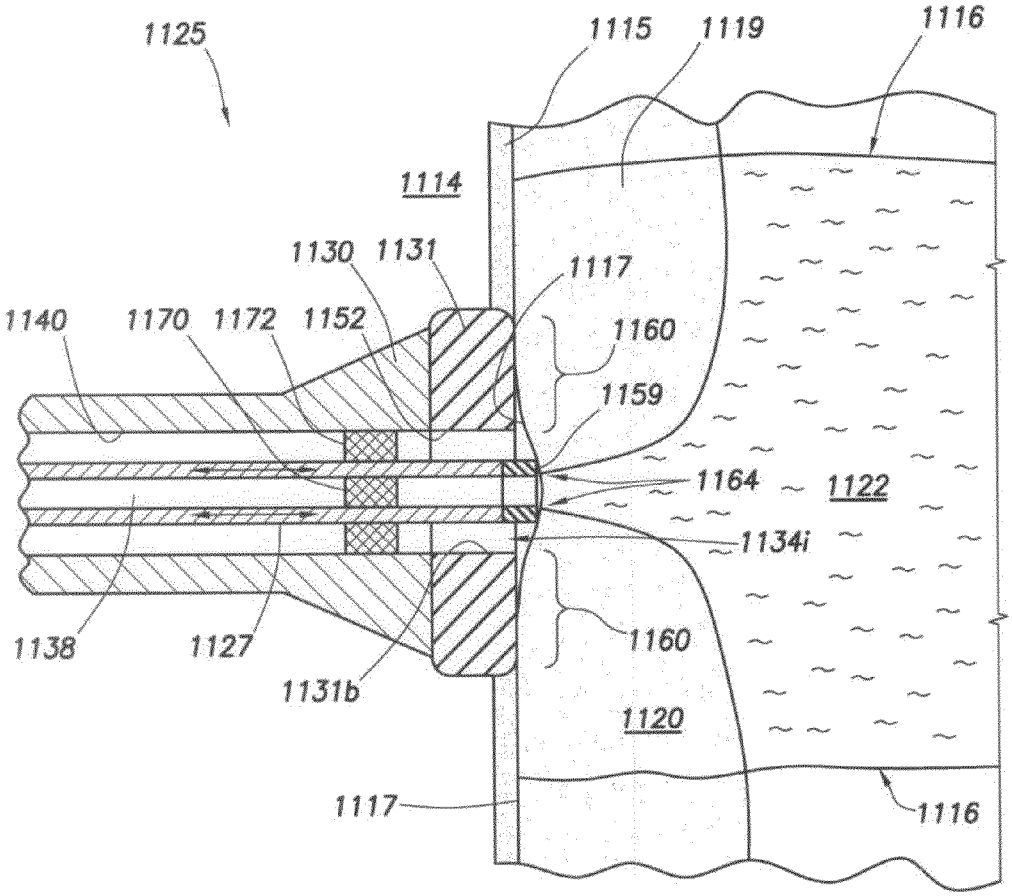
FIG. 11 is a schematic elevational view of an alternate probe assembly to that of FIGS. 5 and 6.

An alternative embodiment of the probe assembly is shown schematically in FIG. 11, and is referenced as 1125. In this embodiment, the (outer) packer 1131 does not include a cleanup inlet per se, but cooperates with an inner packer 1159 for defining an annular cleanup intake 1134*i*. Thus, the outer packer 1131 is carried by the probe body 1130 for sealingly engaging a first annular portion 1160 of the wellbore wall

1117. The wellbore wall 1117 defines the wellbore 1114 and is lined with a mudcake 1115. An invaded zone 1119 surrounds the wellbore wall and extends into a portion of a subterranean formation 1116 having a virgin fluid 1122 therein.

The outer packer 1131 has a bore 1131*b* therethrough. A sampling tube 1127 is disposed in the bore 1131*b* of the outer packer and forms an annulus 1152 therebetween. The sampling tube 1127 is extendable from the probe body 1130 using hydraulic pressure supplied from the downhole tool to energize one or more actuators (as is well known in the art: e.g., U.S. Pat. No. 3,924,463), and carries an inner packer 1159 on a distal end thereof for sealingly engaging a second annular portion 1164 of the wellbore 1114 within the first annular portion 1160. The distal end of the sampling tube preferably comprises an annular channel (not numbered), and the inner packer 1159 is toroidally-shaped and is carried in the annular channel of the distal end of the sampling tube for engagement with the wellbore wall 1117.

The sampling tube 1127 is preferably equipped with a cylindrical filter 1170 for filtering particles from the virgin fluid 1122 (as well as other fluids) admitted to the sampling tube 1127. The annulus 1152 is similarly equipped within a filter 1172 for filtering particles from one of contaminated fluid 1120, virgin fluid 1122, and combinations thereof admitted to the annulus 1152.

The feature of an adjustable sampling tube 1127 provides some responsive capabilities to the forces acting on the inner packer 1159. In particular, this feature is helpful for setting the inner packer 1159 against a weak rock (i.e., weak wellbore wall), and also allows for the adjustment of the inner packer position if the fluid production from the formation is accompanied by erosion of the reservoir rock at the packer-formation interface. This is illustrated by the extension of the inner packer 1159 against the eroded portion of the wellbore wall in the vicinity of the second annular portion 1164.

The probe body 1130 is further equipped with a first inlet 1140 that fluidly communicates with the annulus 1152 for admitting one of virgin fluid 1122, contaminated fluid 1120, and combinations thereof into the downhole tool (not shown in FIG. 11). A support (not shown) may be positioned along an inner surface of one or more of the packers to prevent intrusion of the packer material into the first inlet 1140. A second inlet 1138 in the probe body 1130 fluidly communicates with the sampling tube 1127 for admitting virgin 1122 fluid into the downhole tool.

FIGS. 12A-12E show another embodiment of the probe assembly, referenced as 1225. FIGS. 12A-12E depict the operation of the probe assembly 1225 as it engages the wellbore wall (FIG. 12A), initiates intake of fluid (FIG. 12B), advances to maintain a seal with the wellbore wall during intake (12C), draws fluid into the downhole tool (12D), and retracts to disengage from the wellbore wall (12E).

The probe assembly 1225 is similar to the probe assembly 1125 of FIG. 11, but differs primarily in its fluid filtering means. Accordingly, the movable sampling tube 1227 is equipped with a filter for filtering particles from the virgin fluid (or other fluid) admitted to the sampling tube 1227, in the form of perforations 1227*p* in the sidewall of the sampling tube 1227. The sampling tube is preferably further equipped with an outer flange 1227*f* for ejecting particles from the annulus 1252 upon extension of the sampling tube 1227 relative to a tubular brace 1272 disposed in the annulus 1252 for supporting the outer packer 1231.

The tubular brace 1272 is also equipped with a filter, in the form of perforations 1272*p* in the sidewall of the tubular brace 1272 for filtering particles from the virgin fluid, contaminated fluid, or combinations thereof admitted to the annulus 1252. More particularly, the sampling tube is further equipped with filters, in the form of perforations 1227*q* in the sidewall portion of the sampling tube that supports the flange 1272, that cooperate with the filter 1272*p* of the tubular brace to filter the virgin fluid, contaminated fluid, or combinations thereof admitted to the annulus 1252.

A piston 1270 is further disposed within the sampling tube 1227, the piston being extendable from the probe body (not shown in FIGS. 12A-E) for ejecting particles from the sampling tube upon extension of the piston relative to the sampling tube 1227. The piston may include, e.g., an axial passageway 1271 therein and one or more perforations 1270*p* in a sidewall thereof for conducting virgin fluid admitted to the sampling tube 1227 to the axial passageway 1271. The axial passageway 1271 fluidly communicates with the second inlet (not shown in FIGS. 12A-E) in the probe body.

Figure 12A:
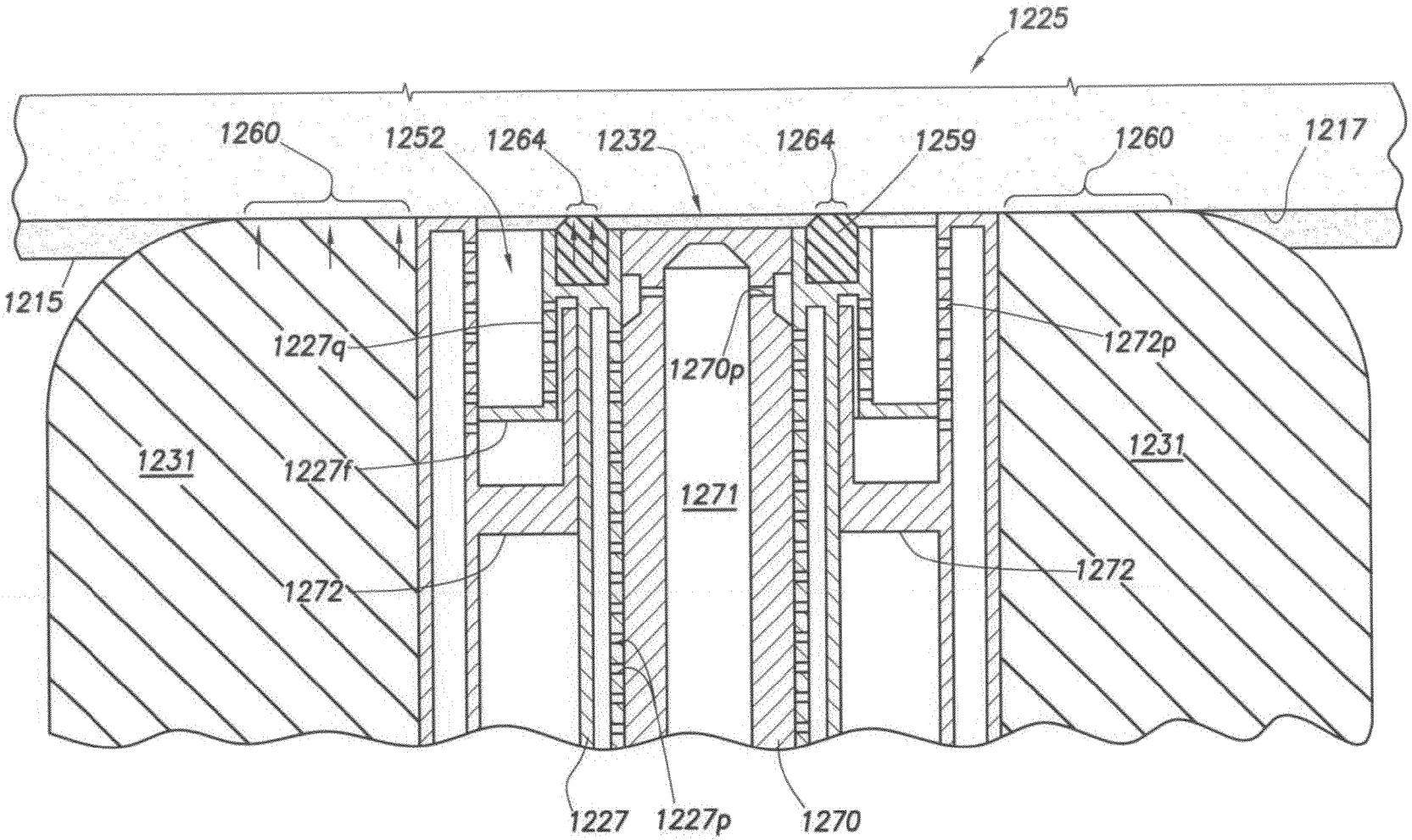
FIG. 12A-E show detailed schematic views, in respective operational sequences, of an alternative probe assembly to that of FIG. 11.

In similar fashion to the sampling tube 1227, the tubular brace 1272 may be extendable from the probe body under hydraulic pressure delivered from the downhole tool. Preferably, the sampling tube 1227 is extendable to a greater degree than the tubular brace 1272 to accommodate erosion of the wellbore, particularly at or near the sampling tube. The ability to extend each of the sampling tube, tubular brace, and piston makes the probe assembly particularly adaptable for use in weak wellbore walls and/or erosive rock conditions. These tubular elements are "nested" for efficiently converting hydraulic pressure supplied by the downhole tool into extension of the members towards and away from the wellbore wall 1217. Thus, when a hydraulic "set" pressure is applied from the downhole tool, the outer packer 1231 and inner packer 1259 are each extended into engagement with the respective first and second annular portions 1260, 1264 of the wellbore wall 1217, as illustrated in FIG. 12A.

Figure 12B:
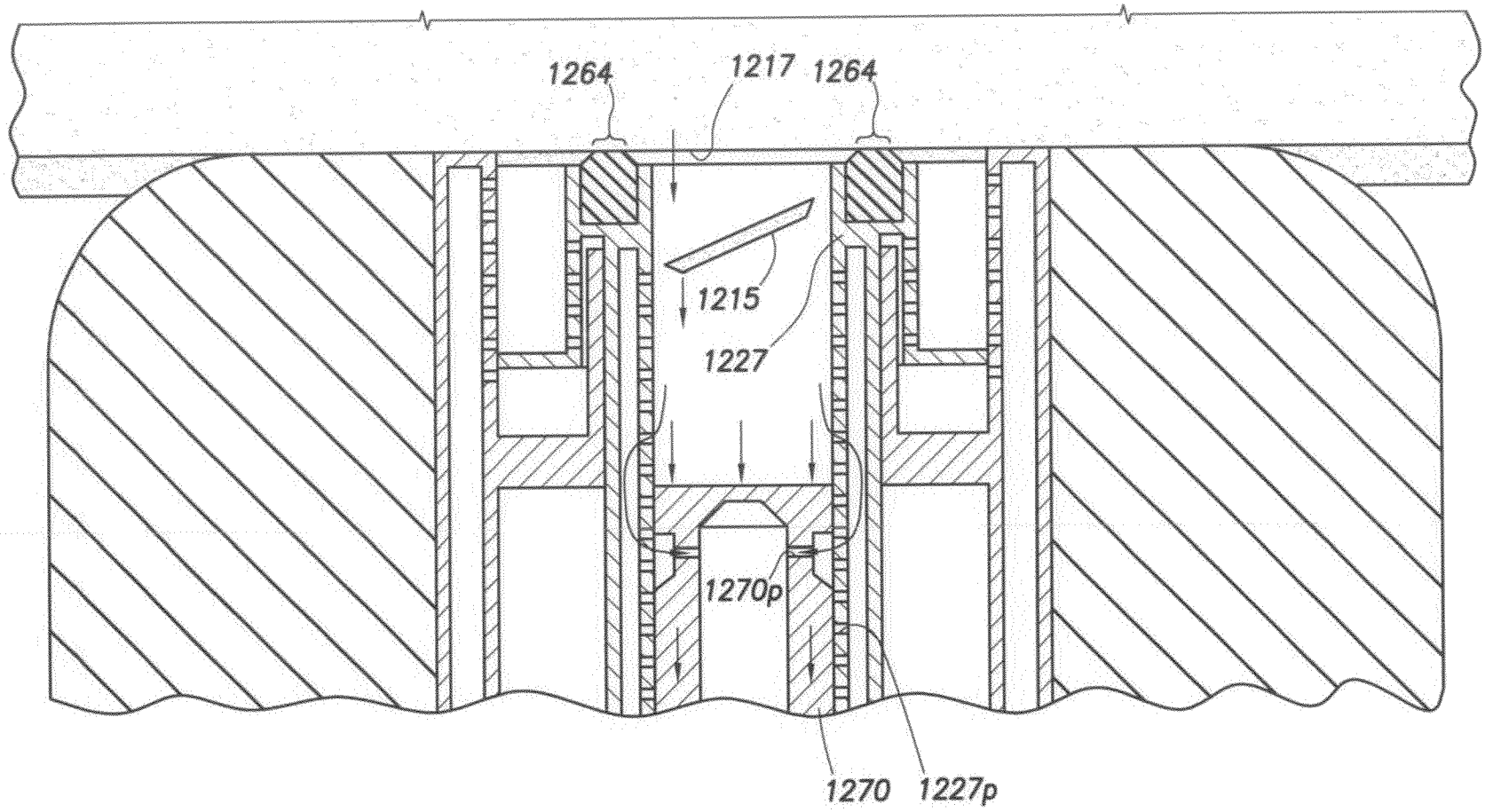

Referring now to FIG. 12B, the piston 1270 is withdrawn using the downhole tool pressure to expose perforations 1270*p* therein to the filtering perforations 1227*p* of the sampling tube 1227. This has the likely effect of pulling a section of the mudcake 1215 free of the wellbore wall 1217 within the first annular region 1264. Fluid passes into the sampling tube 1227 and through the filtered perforations 1227*p* as depicted by the arrows.

Figure 12C:
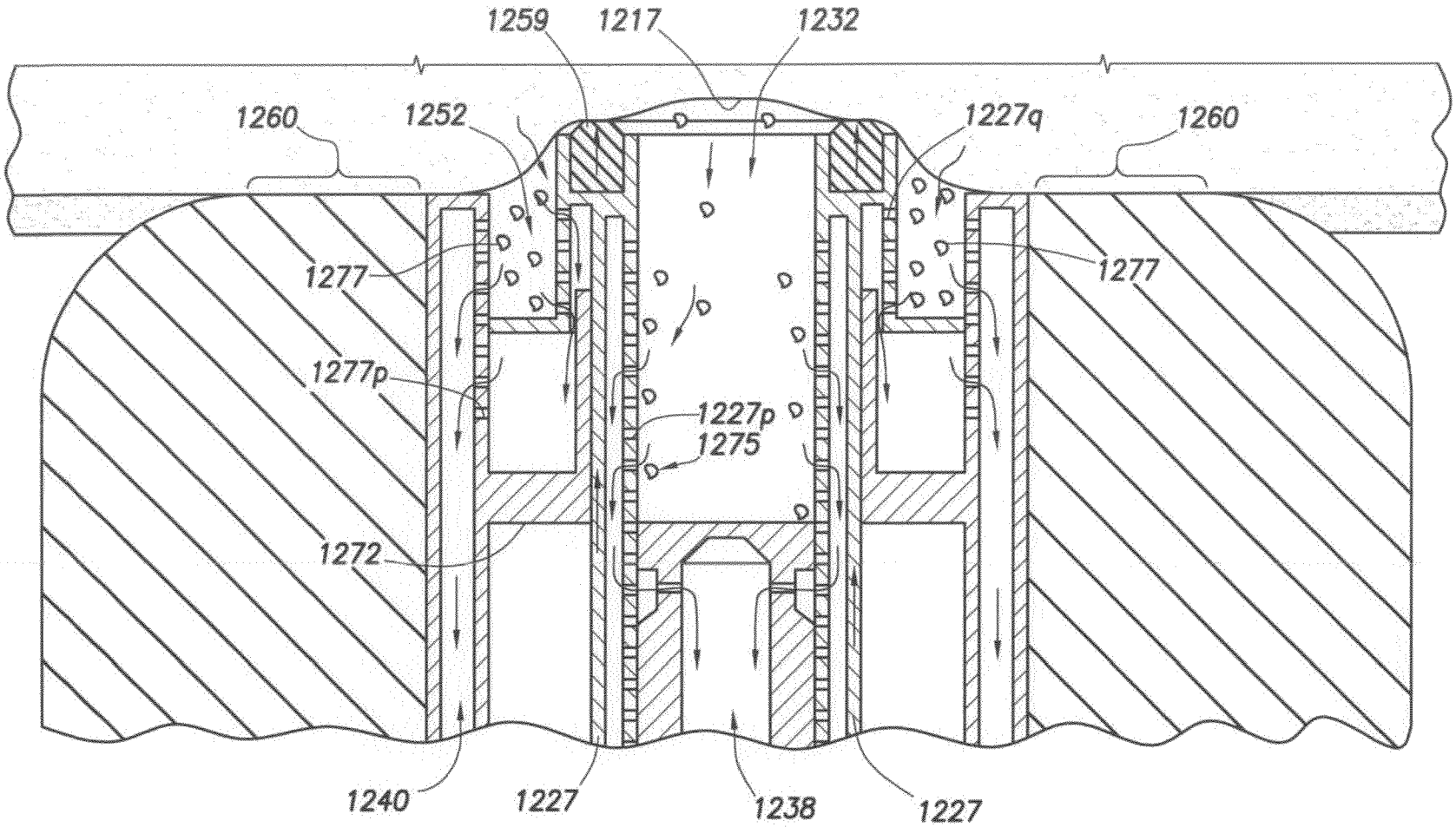

As shown in FIG. 12C, formation fluids is drawn across the wellbore wall 1217 into the annulus 1252 and the sampling intake 1232 under differential pressure provided from the downhole tool (not shown in FIG. 12). The portion of the wellbore wall 1217 between the first annular portion 1260 is shown to have eroded, and the pressure applied to the sampling tube 1227 is seen to have urged the sampling tube, along with the inner packer 1259 outwardly to maintain engagement with the wellbore wall 1217 as the wall erodes.

Fluid-borne particles 1275 and 1277 are shown to have been filtered out by the respective sampling tube filter perforations 1227*p* and tubular brace perforations 1272*p* (the latter also cooperating with sampling tube perforations 1227*q*). The fluid (one of contaminated fluid, virgin fluid, and a combination thereof) flowing through the annulus 1252 past the tubular brace 1272 is admitted to the downhole tool via the first probe inlet 1240 as indicated by the arrows. The fluid (initially, also one of contaminated fluid, virgin fluid, and a combination thereof) flowing through the sampling intake 1232 past the sampling tube 1227 is admitted to the downhole tool via the second probe inlet 1238 as indicated by the arrows. Filtered perforations 1227*p* assist in filtering the fluid as it enters the tool.

Figure 12D:
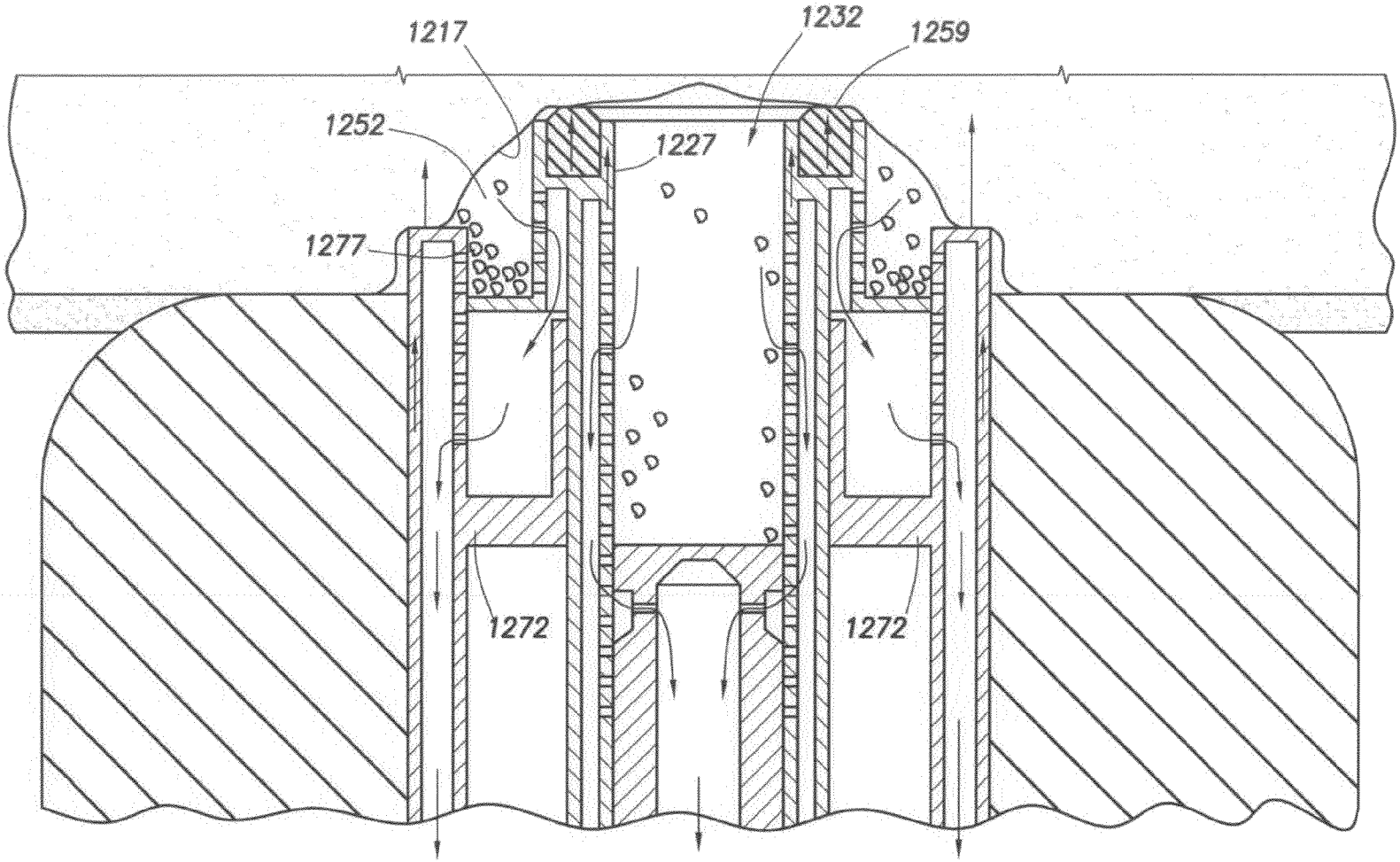

Referring now to FIG. 12D, the tubular brace 1272 and sampling tube 1227 have advanced under applied pressure from the downhole tool into a region of further erosion by the wellbore wall 1217. Also, the filtered particles 1277 are shown as beginning to build up in the annulus 1252. The advancement of the tubular brace maintains a barrier between the sampling intake 1232 and the annular cleanup intake 1252 to prevent cross-flow and/or cross contamination therebetween as the wellbore wall 1217 erodes.

Figure 12E:
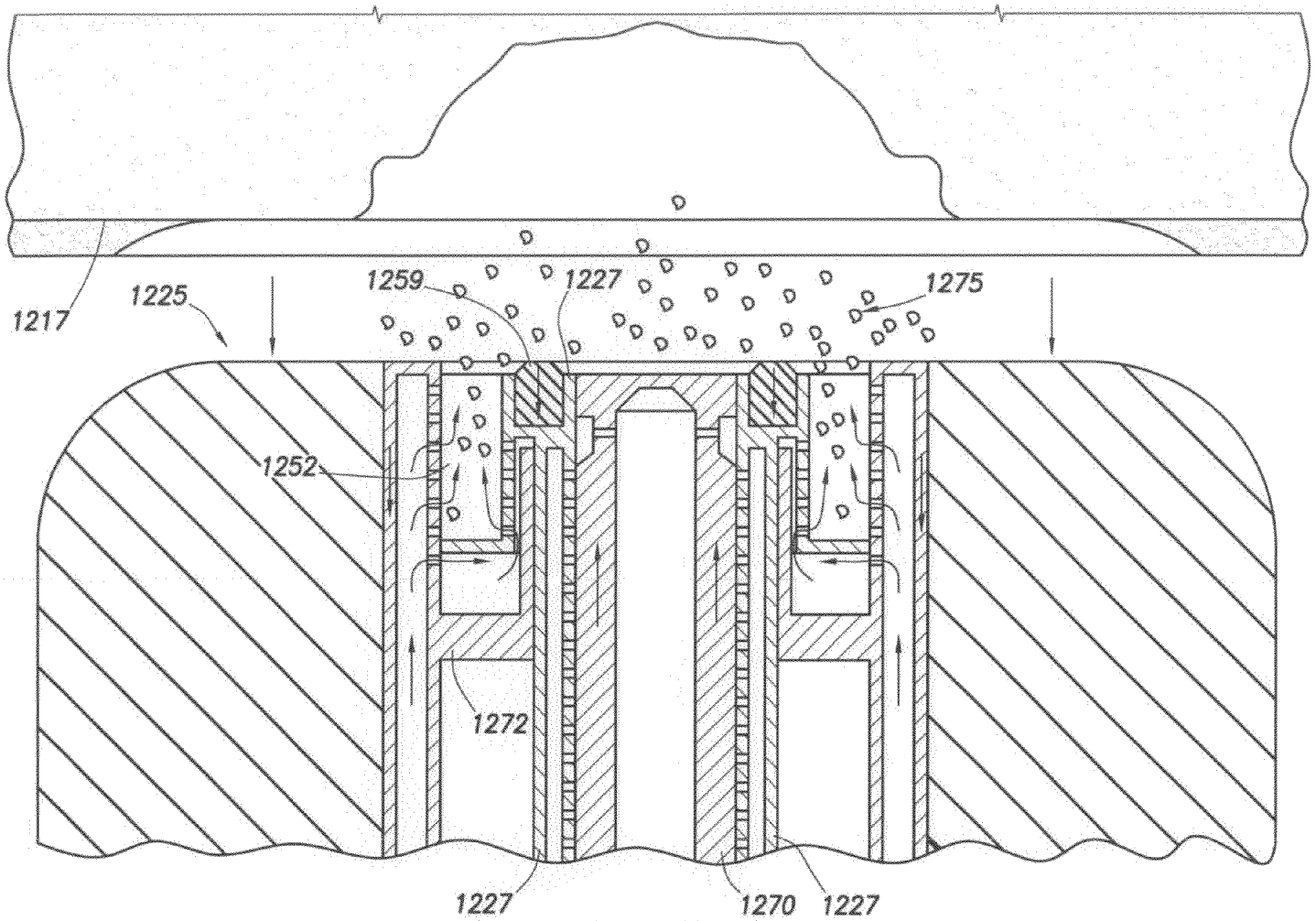

Referring now to FIG. 12E, the probe assembly 1225 is retracted from the wellbore wall 1217 so that the downhole tool may be disengaged from the wellbore wall. The piston 1270 has been fully extended within the sampling tube 1227, thereby ejecting the particles 1275 from the sampling tube. Additionally, the tubular brace 1272 has been retracted, thereby permitting the fluid to be pumped out using a pump within the downhole tool (as described elsewhere herein). Optionally, the sampling tube 1227 may be selectively actuated to move relative to tubular brace 1272. The movement of the sampling tube and tubular brace may be manipulated, e.g., under hydraulic pressure supplied from the downhole tool or from collected formation fluid that is urged to flow back through a fluid flow line or inlet, to eject particles from the annulus 1252. The sampling tube 1227 and inner packer 1259 have also been disengaged from the wellbore wall and retracted into the probe assembly.

Figure 13:
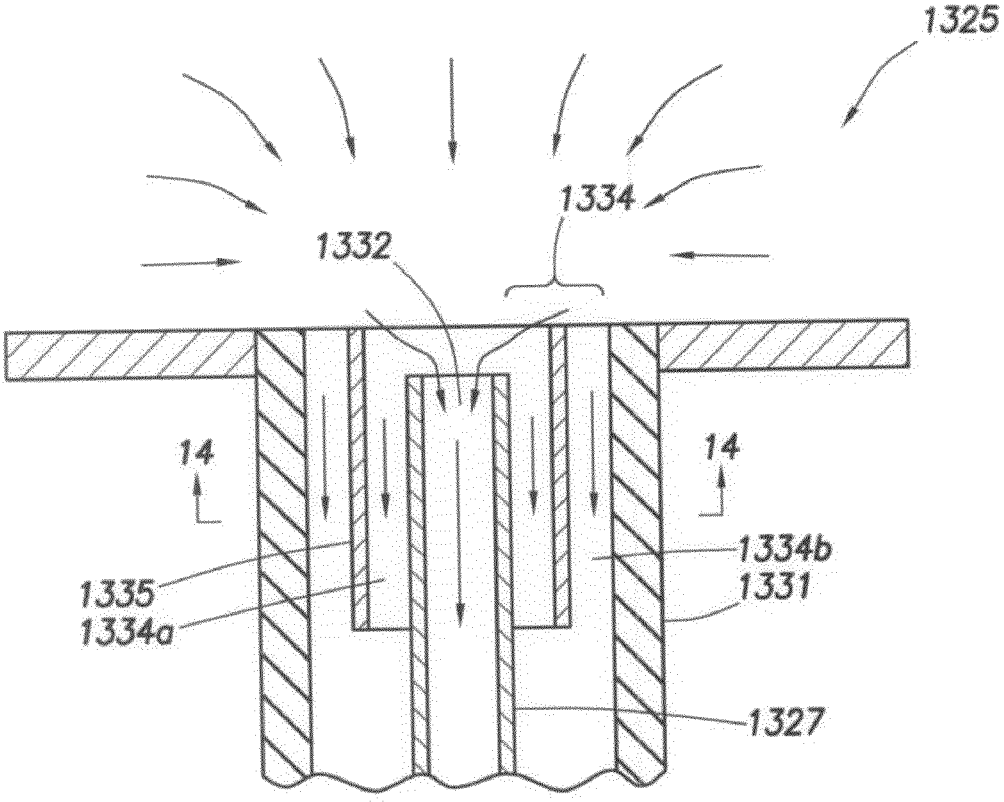
FIG. 13 is a schematic elevational view of an alternate probe assembly having a tubular divider.
Figure 14:
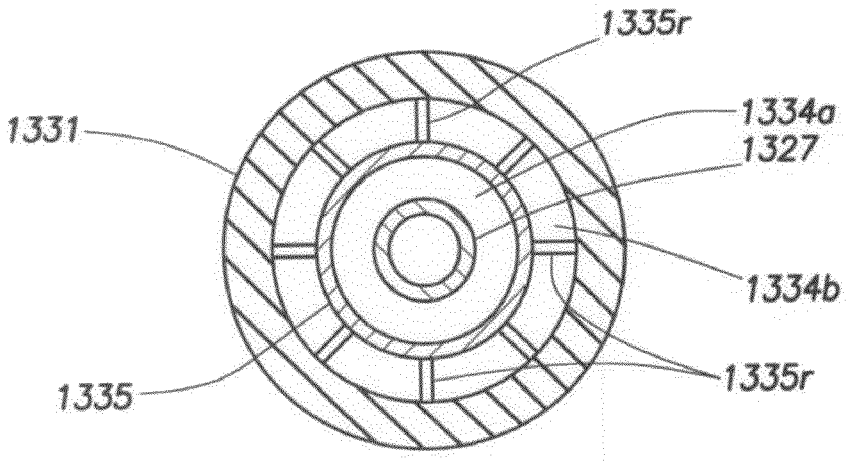
FIG. 14 is a cross-sectional view of the assembly of FIG. 13, taken along section line 14-14.

Another embodiment of the probe assembly 1325 is shown schematically in FIGS. 13-14. FIG. 13 depicts a cross-sectional view of the probe assembly. FIG. 14 depicts a horizontal cross-sectional view of the probe assembly 13 taken along line 14-14. The probe assembly includes a packer 1331 equipped with a continuous annular channel (or, alternatively, a central bore) defining an annular cleanup intake 1334. The sampling tube 1327 is carried by the probe body (not shown in FIGS. 13-14) in a permanent retracted position for non-engagement with the wellbore wall, and defines a sampling intake 1332. Thus, when the probe body is extended from the downhole tool to place the packer 1331 in engagement with the wellbore, the sampling tube 1327 remains separated from the wellbore.

The probe assembly according to this embodiment preferably further includes a tubular divider 1335 disposed in the annular cleanup intake 1334. The tubular divider 1335 is operatively connected to the packer 1331 via a plurality of radial ribs 1335*r* therebetween, such that the tubular divider engages the wellbore wall with the packer (i.e., concurrent with the formation engagement by the packer). This embodiment of the probe assembly may optionally be further equipped with the flexible bracing ring described above, but the bracing ring (not shown in FIGS. 13-14) is recessed well within the annular cleanup intake 1334 to make room for the tubular divider 1335. The tubular divider 1335 has a length less than the length (i.e., thickness) of the packer 1331, thereby defining two annular passageways 1334*a* and 1334*b* in an outer axial portion of the annular cleanup intake 1334. The passageways merge back into a single passageway downstream of the tubular divider 1335.

The separation of the annular cleanup intake 1334 into two isolated areas by the tubular divider 1335 prevents fluid produced across portions of the wellbore wall inside the tubular divider from mixing with fluid produced across portions of the wellbore wall outside the tubular divider. Thus, the inner passageway 1334*a* will tend to be filled with virgin fluid (after an initial flow-through of contaminates), establishing a "buffer" region between the sampling intake 1332 and the outer passageway 1334*b* that may often be filled with contaminated fluid. Because the sampling tube 1327 is retracted from the wellbore wall, however, pressure equalization between the annular cleanup intake 1334 and the sampling intake 1332 is not inhibited. This should help to mitigate the negative effect of pressure pulses that may be created by the pump(s) of the downhole tool pumping fluids through the probe inlets (not shown in FIGS. 13-14).

FIG. 15 shows an alternative embodiment to that of FIGS. 13-14, wherein the packer 1331 is equipped with an inner flange 1331*f* at the mouth thereof restricting the inlet area of the radially outermost annular passageway 1334*b* among the two annular passageways formed by the tubular divider. This restricted inlet expands into an enlarged passageway 1334*b* to create additional room for the contaminated fluid, and help to avoid cross-flow while promoting the capture of virgin formation fluid by the sampling tube 1327.

FIG. 16 is a graph depicting the differential pressure versus share of sampling rate between a sampling intake and a cleanup intake according to another aspect of the present invention. In particular, this inventive aspect relates to the discovery that the performance of the probe assembly can be substantially characterized by three physical parameters: the internal diameter of the sampling tube, and the external and internal diameters of the cleanup annulus (also referred to as the guard annulus). These diameters determine the flow areas of sample and cleanup intakes, and the area of inner packer material separating them. This in turn affects the flow performance of the probe assembly.

The probe/packer geometry may be optimized to define the relationship between the flow ratio and the pressure differential between the sampling and cleanup intakes. This optimization may be used to maximize the flow of virgin fluid into the sampling intake while reducing the amount of cross-flow from the cleanup intake into the sampling intake, thereby reducing the likelihood of contaminated fluid entering the sampling intake. Additionally, the geometry may also be manipulated to lower the pressure differential between the intakes for a given flow ratio and thereby reduce the stress applied to the inner packer. The geometry may optionally be selected to provide little or no pressure differential between the intakes with a flow ratio very close to unity. This configuration allows the use of the same or identical pumps for the sampling and cleanup intakes.

The optimization process involves varying the geometry of the three mentioned diameters until the desirable production ratio(s) have been achieved (cleanup versus sampling intakes) at zero differential pressure at the wellbore wall. FIG. 16 shows a line 1602 indicating the flow through the cleanup intake and line 1604 indicates the flow through the sample intake at various differential pressures between the cleanup and sample intakes. These lines represent a plot for one geometry wherein the inner diameter of the annular cleanup intake is approximately 2 to 2.5 times as wide as the inner diameter of the sampling intake, while the outer diameter of the cleanup intake is approximately 2.5 to 3 times as large as the inner diameter of the sampling intake. This equates to the outer diameter of the cleanup intake being approximately 1.2 times as wide as the inner diameter of the cleanup intake. This configuration allows for production at the sampling intake (see plotted point X) that is approximately 20% of the total production rate, and production at the cleanup intake that is approximately 80% of the total production rate (see plotted point Y), at zero differential pressure 1610 (between sampling and cleanup intakes). Accordingly, the differential pressure may be increased so as to provide production at the sampling intake that is approximately 50% of the total production rate (see plotted point Z, where cleanup and sampling curves cross), well before the undesirable cross-flow from the cleanup intake to the sampling intake (see line 1608) is triggered. The flow of fluid into the respective intakes may be manipulated such that the intersection point Z may be shifted so that it occurs at a variety of differential pressures, including zero differential pressure. Point Q represents a point where the flow through the sampling intake is maximized just before cross-flow between the flowlines (1608) occurs. Manipulation of the flowlines and/or the probe geometry, therefore, may be used to define the points along the graph and generate optimum flow into the tool.

Returning now to FIG. 5, a sampling operation for acquiring virgin formation fluid according to at least one aspect of the present invention will now be fully described. The flow section 521 includes one or more flow control devices, such as the pump 537, a flow line 539, and valves 544, 545, 547 and 549 for selectively drawing fluid into various portions of the flow section 521 via the first probe inlet 540 and the second probe inlet 538 of the probe assembly 525. Accordingly, contaminated fluid 520 is preferably passed from the invaded formation zone 519 into the annular cleanup intake 534*i*, then through the one or more packer passageways 528, into the first probe inlet 540 and subsequently discharged into the wellbore 514. Virgin fluid preferably passes from the formation 516 into the sampling intake 532, through the second probe inlet 538, and then either diverted into one or more sample chambers 542 for collection or discharged into the wellbore 514. Once it is determined that the fluid passing into probe inlet 538 is virgin fluid, valves 544 and/or 549 may be activated using known control techniques by manual and/or automatic operation to divert fluid into the sample chamber 542. It will be apparent to those having ordinary skill in the art that various known fluid-admitting means are suitable for implementation in the flow section 521, such as, e.g., the fluid-admitting means described in U.S. Pat. No. 3,924,463.

The fluid sampling system 526 is also preferably provided with one or more fluid monitoring systems 553 for analyzing the fluid after it enters the flow section 521. The fluid monitoring system 553 may be provided with various monitoring devices, such as an optical fluid analyzer 572 for measuring optical density of the fluid admitted from probe inlet 540 and an optical fluid analyzer 574 for measuring optical density of the fluid admitted from probe inlet 538. The optical fluid analyzers may each be a device such as the analyzer described in U.S. Pat. Nos. 6,178,815 to Felling et al. and/or 4,994,671 to Safinya et al. It will be further appreciated that other fluid monitoring devices, such as gauges, meters, sensors and/or other measurement or equipment incorporating for evaluation, may be used in such as fluid monitoring system 553 for determining various properties of the fluid, such as temperature, pressure, composition, contamination and/or other parameters known by those of skill in the art.

A controller 576 is preferably further provided within the fluid monitoring system 553 to take information from the optical fluid analyzer(s) and send signals in response thereto to alter the pressure differential that induces fluid flow into the sampling intake 532 and/or the annular cleanup intake 534*i* of the probe assembly 525. It will be again be appreciated by those having ordinary skill in the art that the controller may be located in other parts of the downhole tool 510 and/or a surface system (not shown) for operating various components within the wellbore 514.

The controller 576 is capable of performing various operations throughout the fluid sampling system 526. For example, the controller is capable of activating various devices within the downhole tool 510, such as selectively activating the pump 537 and/or valves 544, 545, 547, 549 for controlling the flow rate into the intakes 532, 534*i*, selectively activating the pump 537 and/or valves 544, 545, 547, 549 to draw fluid into the sample chamber(s) 542 and/or discharge fluid into the wellbore 514, to collect and/or transmit data for analysis uphole, and other functions to assist operation of the sampling process.

Figure 1:
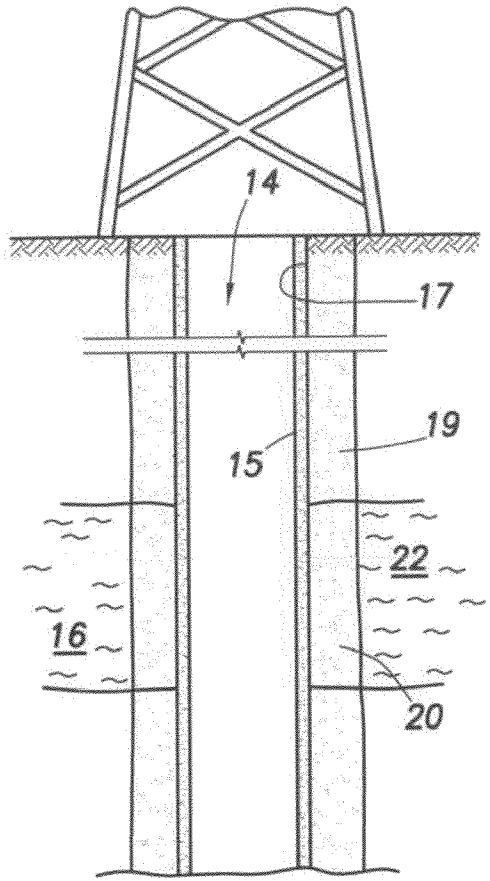
FIG. 1 is a schematic elevational view of a subsurface formation penetrated by a wellbore lined with mudcake.
Figure 3:
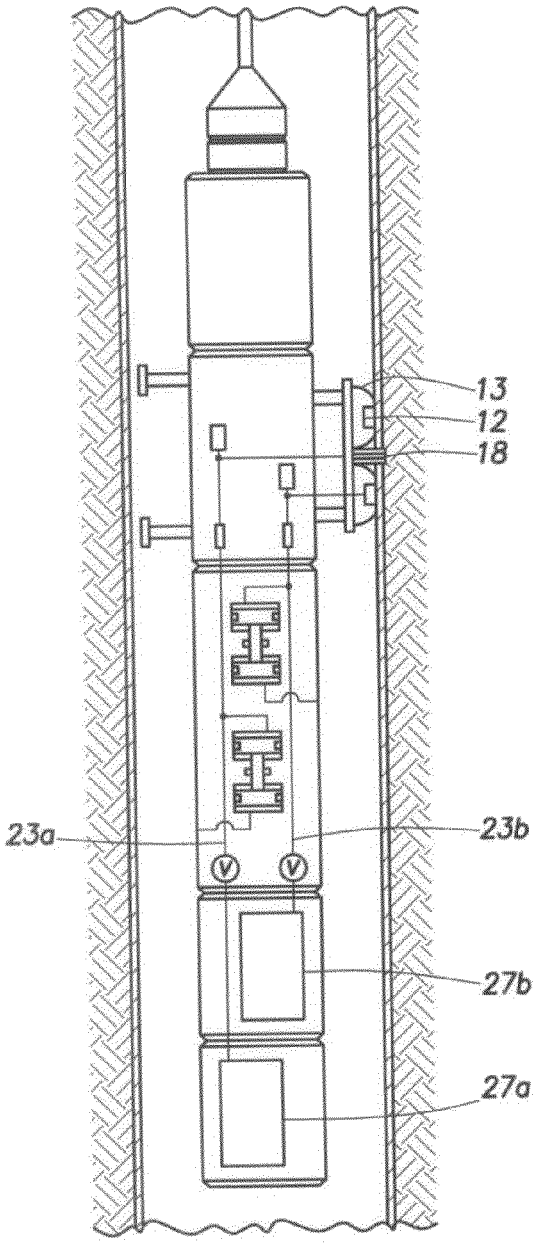
FIG.3 (PRIOR ART)
FIG. 3 is a schematic elevational view of a prior art downhole tool employing a packer equipped with a guard ring for isolating formation fluid flow into a sampling tube.
Figure 4:
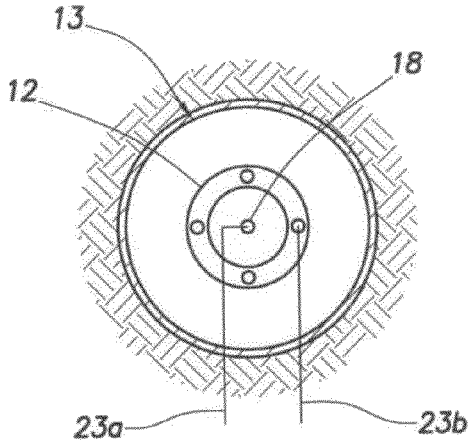
FIG.4 (PRIOR ART)
FIG. 4 is a side sectional view of the packer of FIG. 3.

With continuing reference to FIG. 5, the flow pattern of fluid passing into the downhole tool 510 is illustrated. Initially, as shown in FIG. 1, an invaded zone 519 surrounds the borehole wall 517. Virgin fluid 522 is located in the formation 516 behind the invaded zone 519. As the fluid flows into the intakes 532, 534*i*, the contaminated fluid 522 in the invaded zone 519 near the intake 532 is eventually removed and gives way to the virgin fluid 522. At some time during the process, as fluid is extracted from the formation 516 into the probe assembly 525, virgin fluid 522 breaks through and enters the sampling tube 527 as shown in FIG. 5. Thus, from this point only virgin fluid 522 is drawn into the sampling intake 532, while the contaminated fluid 520 flows into the annular cleanup intake 534*i* of the probe assembly 525. To enable such result, the flow patterns, pressures and dimensions of the probe may be altered to achieve the desired flow path, particularly to resist crossflow from the annular cleanup intake 534*i* to the sampling intake 532, as described above.

The details of certain arrangements and components of the fluid sampling system described above, as well as alternatives for such arrangements and components would be known to persons skilled in the art and found in various other patents and printed publications, such as, those discussed herein. Moreover, the particular arrangement and components of the downhole fluid sampling system may vary depending upon factors in each particular design, or use, situation. Thus, neither the fluid sampling system nor the present invention are limited to the above described arrangements and components, and may include any suitable components and arrangement. For example, various flow lines, pump placement and valving may be adjusted to provide for a variety of configurations. Similarly, the arrangement and components of the downhole tool and the probe assembly may vary depending upon factors in each particular design, or use, situation. The above description of exemplary components and environments of the tool with which the probe assembly and other aspects of the present invention may be used is provided for illustrative purposes only and is not limiting upon the present invention.

The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method, comprising:

extending a probe from a downhole tool into contact with a wall of a wellbore penetrating a subsurface formation, the probe including a packer for creating a seal against the wall of the wellbore, a sampling intake, a cleanup intake, and a tubular divider disposed in a bore of the packer for engaging the wall of the wellbore;

producing fluid from the formation about the tubular divider;

drawing fluid from inside the tubular divider into the sampling intake;

drawing fluid from inside and outside the tubular divider into the cleanup intake;

flowing fluid through a first flow line coupled to the sampling intake and through a second flow line coupled to the cleanup intake;

capturing fluid from the first flow line into a sample chamber; and discharging fluid from the second flow line into the wellbore.

2. The method of claim 1 further comprising isolating two annular passageways of the cleanup intake with the tubular divider.

3. The method of claim 1 further comprising obtaining a property of the fluid flowing through at least one of the first flow line and the second flow line.

4. The method of claim 1 further comprising filtering the fluid flowing through at least one of the first flow line and the second flow line.

5. The method of claim 1 further comprising admitting the fluid from inside the tubular divider into a sampling tube.

6. The method of claim 1 further comprising equalizing the pressure between the sampling intake and the cleanup intake.

7. The method of claim 1 further comprising preventing the fluid from outside the tubular divider from mixing with the fluid entering the sampling intake.

8. The method of claim 1 further comprising restricting an inlet area of an annular passageway outside the tubular divider with an inner flange at the mouth of the packer.

* * * * *